US005655931A

United States Patent [19]

Perugini

[11] Patent Number: 5,655,931

[45] Date of Patent: Aug. 12, 1997

[54] ELECTRICAL CONNECTOR WITH COMBINED ELECTRICAL CONTACT AND HOUSING MOUNT ASSEMBLY

[75] Inventor: Michael N. Perugini, Monroe, Conn.

[73] Assignee: Framatome Connectors USA Inc., Norwalk, Conn.

[21] Appl. No.: 539,767

[22] Filed: Oct. 2, 1995

[51] Int. Cl.[6] ..... H01R 13/73

[52] U.S. Cl. ..... 439/573; 439/97

[58] Field of Search ..... 439/573, 801, 439/92, 97, 108

[56] References Cited

U.S. PATENT DOCUMENTS

| | | | |
|---|---|---|---|
| 3,881,799 | 5/1975 | Elliott et al. | 339/252 R |
| 4,427,247 | 1/1984 | Peterson | 439/92 |
| 4,734,044 | 3/1988 | Radice | 439/78 |
| 4,820,173 | 4/1989 | Thom et al. | 439/79 |
| 5,207,588 | 5/1993 | Ladouceur et al. | 439/84 |
| 5,249,983 | 10/1993 | Hirai | 439/573 |
| 5,370,559 | 12/1994 | Matsuoka | 439/733 |
| 5,380,227 | 1/1995 | Taylor | 439/801 |

*Primary Examiner*—P. Austin Bradley
*Assistant Examiner*—T. C. Patel
*Attorney, Agent, or Firm*—Perman & Green

[57] ABSTRACT

An electrical connector for a printed circuit board having a housing and a combined electrical contact and housing mount assembly. The assembly has a first member and a second member. The first member passes through the housing. A ledge on the first member is located on a ledge of the housing. The second member is connected to the second member such that they can sandwich a portion of the printed circuit board therebetween. The bottom of the first member extends past a bottom portion of the housing to make electrical contact with a contact pad on the printed circuit board.

10 Claims, 1 Drawing Sheet

FIG. 1A

ELECTRICAL CONNECTOR WITH COMBINED ELECTRICAL CONTACT AND HOUSING MOUNT ASSEMBLY

BACKGROUND OF THE INVENTION

1. Field of the Invention

The present invention relates to electrical connectors and, more particularly, to an electrical contact assembly that also mounts a housing to a printed circuit board.

2. Prior Art

U.S. Pat. No. 3,881,799 discloses a pin contact with a head having a contact junction. U.S. Pat. No. 5,207,588 discloses an electrical grounding stud. U.S. Pat. No. 4,734,044 discloses use of rivets to connect conductors to a piezoelectric film and plastic strips. Other patents that disclose connectors include U.S. Pat. Nos. 5,370,559 and 4,820,173.

SUMMARY OF THE INVENTION

In accordance with one embodiment of the present invention an electrical connector for a printed circuit board is provided comprising a housing and a combined electrical contact and housing mount assembly. The assembly is provided for connecting the housing to the printed circuit board and as an electrical contact for connecting the printed circuit board to a second electrical connector. The assembly has a first member passing through the housing with a surface interlocked with the housing and a second member attached to the first member. The first and second members are suitably sized and shaped to contact opposite sides of the printed circuit board, sandwich a portion of the board therebetween, and make electrical contact with a contact pad on the board located under the housing.

In accordance with another embodiment of the present invention an electrical connector for a printed circuit board is provided comprising a housing and an electrical contact and housing mount assembly. The housing is made of dielectric material having a hole therethrough with a first ledge in the hole. The assembly is for connecting the housing to a printed circuit board and providing a contact surface for connection to a contact in a second electrical connector. The assembly comprises a first member with a second ledge on its exterior and an interior threaded area, and a second member with a threaded shaft. The first member extends through the hole in the housing with the ledges contacting each other and a bottom of the first member projecting from a bottom of the housing. The second member is connected to the first member in the interior threaded area with the first and second members contacting opposite sides of the printed circuit board to sandwich a portion of the board therebetween. The first member makes electrical contact with a contact pad on the board under the first member.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
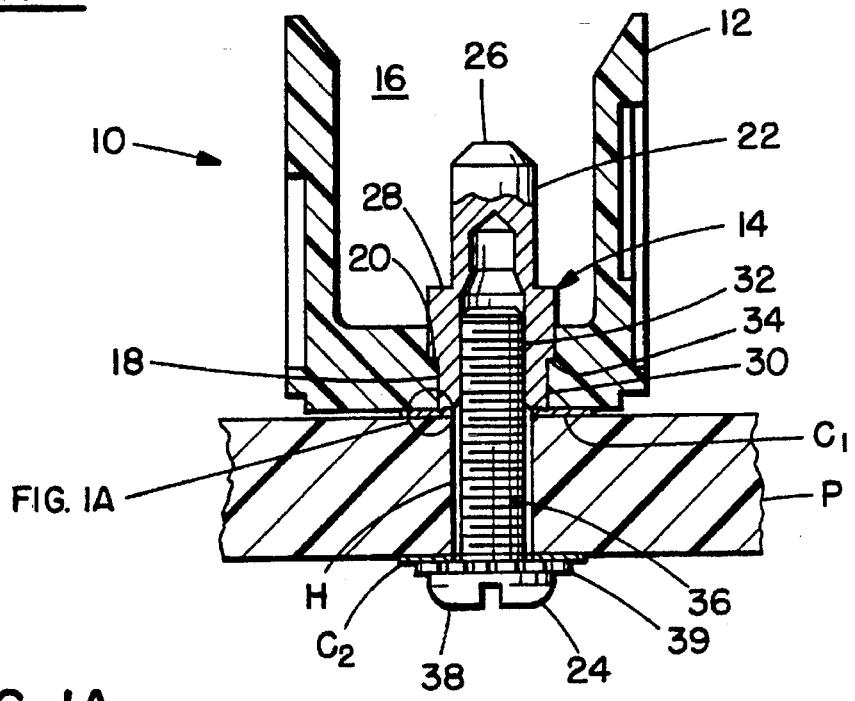
FIG. 1 is a cross-sectional view of an electrical connector incorporating features of the present invention shown connected to a printed circuit board.

Referring to FIG. 1, there is shown a cross-sectional view of an electrical connector 10 incorporating features of the present invention. Although the present invention will be described with reference to the single embodiment shown in the drawings, it should be understood that the present invention can be embodied in various different forms of alternate embodiments. Features of the present invention may also be incorporated into different types of electrical connectors other than a printed circuit board connector. In addition, any suitable size, shape or type of elements or materials could be used.

The connector 10 generally comprises a housing 12 and a combined electrical contact and housing mount assembly 14. Preferably, the connector 10 also has other contacts (not shown). The housing 12 is made of dielectric material and forms a receiving area 16 for receiving at least a portion of a second electrical connector (not shown). The housing 12 has a hole 18 that passes therethrough. An upwardly facing ledge 20 is located in the hole 18 that interlocks with the assembly 14. In alternate embodiments, other types of housings could be provided.

Figure 2:
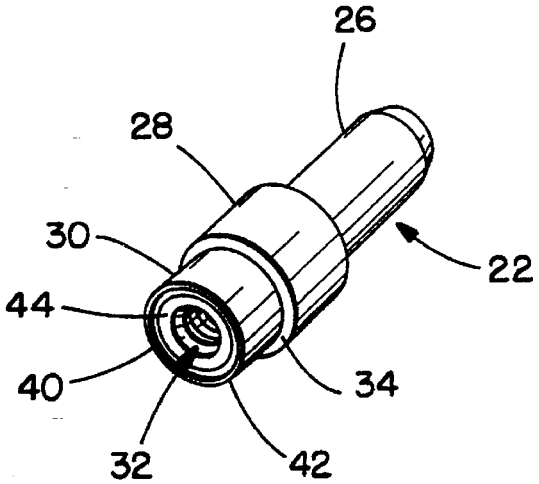
FIG. 2 is a perspective view of an electrical contact piece shown in FIG. 1.

The assembly 14 generally comprises a first member 22 and a second member 24. Referring also to FIG. 2, the first member 22 is comprised of electrically conductive material and has a general column shape. However, in alternate embodiments other shapes could be provided. The first member 22 has a top section 26, an enlarged width middle section 28, and a bottom section 30. A threaded hole 32 extends into the first member 22 from its bottom. A downwardly facing ledge 34 is formed at the junction of the middle section 28 and bottom section 30. The two ledges 20, 34 engage each other to locate the first member 22 at a fixed position relative to the housing 12 when connected to the printed circuit board P. The top section 26 extends into the receiving area 16 for connection to a contact in the second electrical connector (not shown) inserted to the receiving area 16.

The printed circuit board P has a hole H therethrough and a contact pad $C_1$ on its top surface. The second member 24 of the assembly 14 has a threaded shaft 36 and a head 38. When the connector 10 is connected to the printed circuit board P, the second member 24 extends through the hole H and into the threaded hole 32 of the first member 22. The head 38 comes to rest against a star washer 39 which is pressed into a second contact pad $C_2$ at the bottom side of the board P. The housing 12 and first member 22 come to rest on the top side of the board P.

Figure 1A:
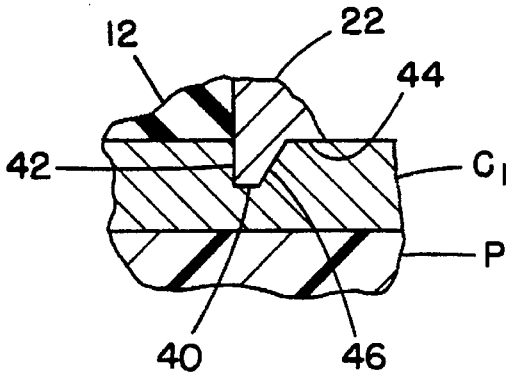
FIG. 1A is an enlarged view of area 1A shown in FIG. 1.

Referring also to FIG. 1A, the bottom 40 of the first member 22 has a peripheral piercing ring 42 and an interior surface 44. The inner side 46 of the piercing ring 42 is sloped. When the second member 24 is secured into the first member 22, the bottom 40 of the first member 22 contacts the top contact pad $C_1$. Further tightening of the second member 24 into hole 32 causes the piercing ring 42 to penetrate into the top contact pad $C_1$ until the interior surface 44 contacts the top contact pad $C_1$. Due to the clamping pressure exerted during assembly by the second member 24, and the resulting compression of the displaced portion of the contact pad $C_1$ within the interior periphery of the piercing ring 42, the portion of the contact pad $C_1$ in intimate contact with the surfaces 44 and 46 creates a gas tight (GTH) electrical interface. The connection causes a portion of the printed circuit board P to be fixedly sandwiched between the head 38 of the second member 24 and the bottom 40 of the first member 22. Because of the interlocking nature of the two ledges 20, 34, the housing is pulled against the printed circuit board P by the first member 22. In an alternate embodiment the first member could be screwed into the housing. This stationarily mounts the housing 12 to the printed circuit board P. In addition, the first member 22 functions as an electrical contact between the top contact pad $C_1$ and a second electrical connector (not shown) inserted into the receiving area 16.

The assembly 14 provides two significant features. First, it provides an increased area of electrical contact of the assembly with the printed circuit board P. Second, it provides long term stability and reliability due to piercing of the top contact pad $C_1$ by the piercing ring 42. In the past, connectors similar to the connector 10 relied only upon an area of contact between the contact and the printed circuit board similar to the area of contact at star washer 39 transferred inside hole 32. However, the surface area provided by screw threads alone from a member similar to member 24 to a member inside a housing has been found to be incapable of providing sufficient surface area for proper conductivity of higher currents, such as 20 amps or more. This insufficient surface area has been found to increase constrictive resistance and temperature rise. This results in a wide variations in voltage drops. The connector 10, on the other hand, has been designed to accommodate higher currents. The housing 12 and first member 22 have been designed to allow the first member 22 to pass through the housing and directly contact pad $C_1$. This increases the electrical surface area of contact. This eliminates constrictive resistance and the resulting temperature rise seen in prior art devices. Piercing the top contact pad $C_1$ also increases the surface area of contact and, promotes long term stability and reliability.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An electrical connector for a printed circuit board, the connector comprising:

a housing; and a combined electrical contact and housing mount assembly for connecting the housing to the printed circuit board, the assembly having a first member passing through the housing and having a surface interlocked with the housing, and a second member attached to the first member, the first and second members being suitably sized and shaped to contact opposite sides of the printed circuit board, sandwich a portion of the board therebetween, and make electrical contact with a contact pad of the board located under the housing, wherein a bottom of the first member is suitably sized and shaped to pierce into the contact pad.

2. A connector as in claim 1 wherein the bottom of the first member extends past a bottom portion of the housing to make contact with the contact pad.

3. A connector as in claim 1 wherein the bottom of the first member has a peripheral piercing ring that pierces into the contact pad.

4. A connector as in claim 1 wherein the second member is threadingly connected to the first member in a threaded hole of the first member.

5. A connector as in claim 1 wherein the first member extends into a second connector receiving area of the housing.

6. An electrical connector for a printed circuit board, the connector comprising:

a housing made of dielectric material having a hole therethrough with a first ledge in the hole;

an electrical contact and housing mount assembly for connecting the housing to the printed circuit board and providing a contact surface for connection to a contact in a second electrical connector, the assembly comprising a first member with a second ledge on its exterior and an interior threaded area, and a second member with a threaded shaft, the first member extending through the hole in the housing with the ledges contacting each other and a bottom of the first member projecting from a bottom of the housing, wherein the second member is connected to the first member in the interior threaded area with the first and second members contacting opposite sides of the printed circuit board to sandwich a portion of the board therebetween and the first member making electrical contact with a contact pad on the board under the first member.

7. A connector as in claim 6 wherein the first member extends into a second connector receiving area of the housing.

8. A connector as in claim 6 wherein the bottom of the first member is suitably sized and shaped to pierce into the contact pad.

9. A connector as in claim 8 wherein the bottom of the first member has a peripheral piercing ring that pierces into the contact pad.

10. A connector as in claim 8 wherein the first connector has a general column shape with its bottom being located to contact the contact pad.

* * * * *